US005117729A

United States Patent [19]

Kunimoto

[11] Patent Number: 5,117,729

[45] Date of Patent: Jun. 2, 1992

[54] MUSICAL TONE WAVEFORM SIGNAL GENERATING APPARATUS SIMULATING A WIND INSTRUMENT

[75] Inventor: Toshifumi Kunimoto, Hamamatsu, Japan

[73] Assignee: Yamaha Corporation, Hamamatsu, Japan

[21] Appl. No.: 520,231

[22] Filed: May 8, 1990

[30] Foreign Application Priority Data

May 9, 1989 [JP] Japan ..... 1-115546

[51] Int. Cl.[5] ..... G10H 1/08; G10H 1/12

[52] U.S. Cl. ..... 84/660; 84/661; 84/DIG. 9; 84/DIG. 10

[58] Field of Search ..... 84/622, 625, 660, 661, 84/697-700, 735, 736, DIG. 9, DIG. 10; 381/61

[56] References Cited

U.S. PATENT DOCUMENTS

| | | | |
|---|---|---|---|
| 4,475,229 | 10/1984 | Frese . | |
| 4,548,119 | 10/1985 | Wachi et al. . | |
| 4,554,858 | 11/1985 | Wachi et al. | 84/DIG. 9 |
| 4,736,663 | 4/1988 | Wawrzynek et al. . | |
| 4,815,354 | 3/1989 | Kunimoto | 84/DIG. 9 |
| 4,829,463 | 5/1989 | Kakishita et al. | 84/DIG. 9 |
| 4,841,828 | 6/1989 | Suzuki | 84/DIG. 9 |
| 4,909,121 | 3/1990 | Usa et al. | 84/DIG. 9 |

FOREIGN PATENT DOCUMENTS

| | | |
|---|---|---|
| 0248527 | 4/1987 | European Pat. Off. . |
| 63-40199 | 2/1988 | Japan . |

OTHER PUBLICATIONS

"On the oscillations of musical instruments", *J. Acoust. Soc. Am.*, M. E. McIntyre, et al., Nov. 1983, pp. 1324-1345.

*Primary Examiner*—Stanley J. Witkowski
*Attorney, Agent, or Firm*—Graham & James

[57] ABSTRACT

A musical tone waveform signal generating apparatus is used to generate the waveform signal full of variety which simulates the sound waveform of wind instrument. This apparatus provides a loop including first and second signal lines through which the waveform signal is circulated. Both of first and second signal lines are connected to a conversion portion which receives the waveform signal from the second signal line and a musical tone control signal which is used to control a musical parameter of a musical tone to be generated. The conversion portion effects the predetermined non-linear conversion on the waveform signal in response to the musical tone control signal so that a converted waveform signal to be obtained from the conversion portion is to be outputted to the first signal line. A transmission portion to which both of first and second signal lines are connected transmits the waveform signal from the first signal line to the second signal line and delays the waveform signal by a delay time corresponding to a pitch of the musical tone to be generated. Further, a signal loop portion inserted between the conversion portion and transmission portion mixes the waveform signals on first and second signal lines by transmitting the waveform signal on one of first and second signal lines to the other of first and second signal lines.

4 Claims, 9 Drawing Sheets

MUSICAL TONE WAVEFORM SIGNAL GENERATING APPARATUS SIMULATING A WIND INSTRUMENT

BACKGROUND OF THE INVENTION

1. Field of the Invention

The present invention relates to a musical tone waveform signal generating apparatus which generates a musical tone waveform signal in response to a musical parameter inputted thereto.

2. Prior Art

Conventionally, Japanese Patent Laid-Open Publication No. 63-40199 discloses the known musical tone waveform signal generating apparatus, which provides first and second signal lines, input portion and transmission portion. Herein, the waveform signal is transmitted forward in the first signal line, and then returned backward in the second signal line. The input portion inputs both of the waveform signal from the second signal line and the musical tone control signal for controlling the musical parameters of the musical tone to be generated. In response to the musical tone control signal, the input portion varies the contents of the waveform signal, which is then outputted to the first signal line. The transmission portion delays the waveform signal from the first signal line by the delay time corresponding to the pitch of the musical tone to be generated, and then the delayed waveform signal is fed back to the second signal line. The input portion is designed in accordance with the mouth-piece of the wind instrument to be simulated, while the transmission portion is designed in accordance with the resonance tube of the wind instrument. When the musical tone control signal corresponding to the performance information is applied to the input portion from the external device, this apparatus generates the waveform signal in response to the musical tone control signal, so that this apparatus can simulate the tone-generation of the wind instrument.

In the above-mentioned conventional apparatus, the input portion is directly connected to the transmission portion. Therefore, the conventional apparatus cannot simulate the characteristic of air-flow which is flown through the gap formed between the mouth-piece and reed of the wind instrument. Thus, there is a problem in that the conventional apparatus cannot simulate the musical tone generated from the wind instrument well.

SUMMARY OF THE INVENTION

It is accordingly a primary object of the present invention to provide a musical tone waveform signal generating apparatus capable of simulating the tone-generation of the wind instrument well so that the musical tone full of variety can be generated.

It is another object of the present invention to provide a musical tone waveform signal generating apparatus capable of generating the musical tone waveform signal full of variety.

In an aspect of the present invention, there is provided a musical tone waveform signal generating apparatus comprising:

(a) a first signal line through which a waveform signal is transmitted in forward direction;

(b) a second signal line through which the waveform signal outputted from the first signal line is transmitted in backward direction, so that the waveform signal is circulated in a loop including the first and second signal lines wherein characteristic of the waveform signal is to be varied;

(c) conversion means which receives the waveform signal from the second signal line and a musical tone control signal which is used to control a musical parameter of a musical tone to be generated, the conversion means converting the waveform signal in response to the musical tone control signal so that a converted waveform signal to be obtained from the conversion means is to be outputted to the first signal line;

(d) transmission means for transmitting the waveform signal from the first signal line to the second signal line while at least delaying the waveform signal by a delay time corresponding to a pitch of the musical tone to be generated, so that a delayed waveform signal to be outputted from the transmission means is fed back to the second signal line; and (e) signal loop means which is inserted between the conversion means and the transmission means, the signal loop means mixing the waveform signals on the first and second signal lines by transmitting the waveform signal on one of the first and second signal lines to the other of the first and second signal lines.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings.

DESCRIPTION OF THE PREFERRED EMBODIMENTS

Figure 1:
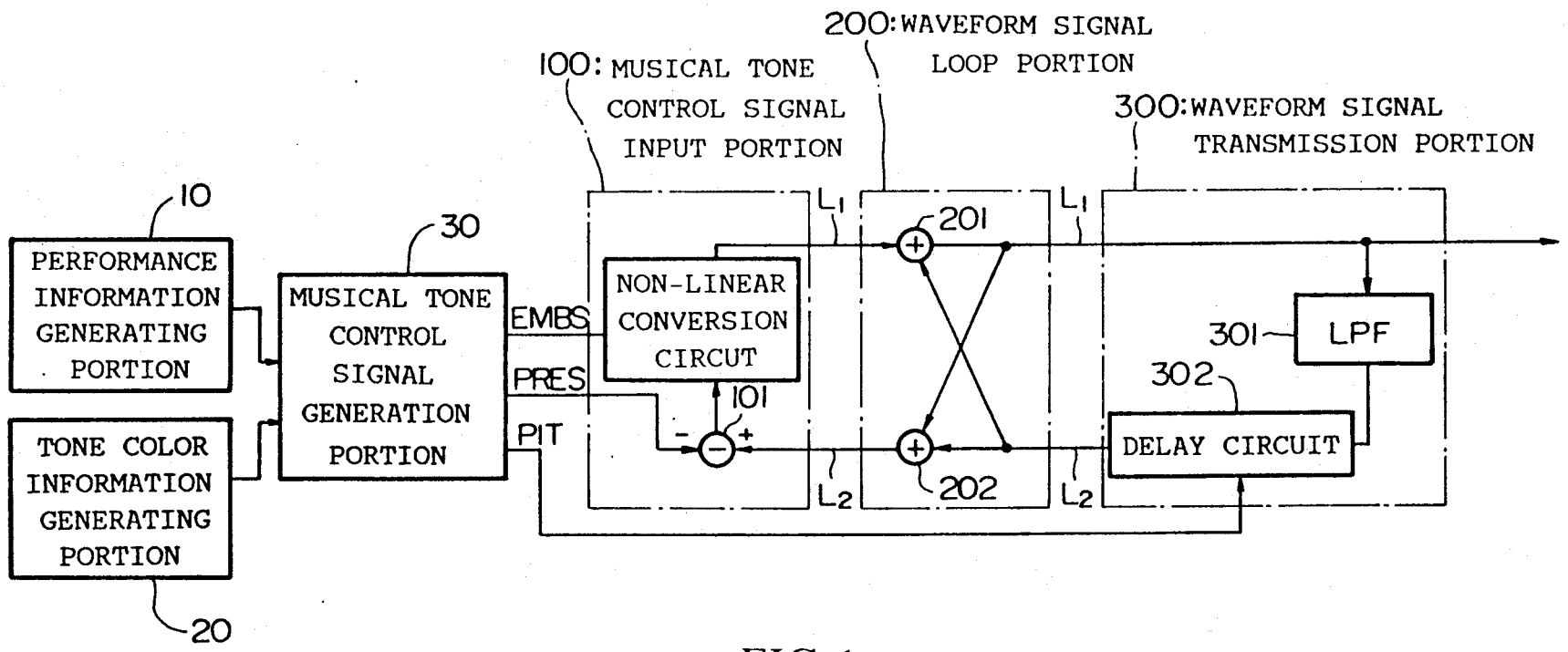
FIG. 1 is a block diagram showing the basic configuration of the electronic musical instrument including the musical tone waveform signal generating apparatus according to the present invention.

Next, description will be given with respect to the preferred embodiments of the present invention by referring to the drawings, wherein like reference characters designate like or corresponding parts throughout the several views.

[A] BASIC CONFIGURATION AND OPERATION OF PRESENT INVENTION (1) Basic Configuration First, description will be given with respect to the basic configuration of the musical tone waveform signal generating apparatus according to the present invention.

In FIG. 1, an electronic musical instrument provides a performance information generating portion 10, a tone color information generating portion 20 and a musical tone control signal generating portion 30. Based on the performance information from the performance information generating portion 10 and the tone color information from the tone color information generating portion 20, the musical tone control signal generating portion 30 generates the musical tone control signal, which is then applied to a musical tone waveform signal generating apparatus consisting of a musical tone control signal input portion 100, a waveform signal loop portion 200 and a waveform signal transmission portion 300.

The performance information generating portion 10 provides a keyboard including plural keys corresponding to musical scales and other circuits to be accompanied with keyboard such as key-depression detecting circuit for detecting a key-depression event of each key, an initial-touch detecting circuit for detecting an initial-touch (i.e., key-depression speed), an after-touch detecting circuit for detecting an after-touch (i.e., key-depressing pressure or key-depressed depth) and the like. Thus, the performance information generating portion 10 generates the performance information representative of the key-depression event, initial-touch, after-touch etc. The tone color information generating portion 20 provides tone color selecting switches and their switch operation detecting circuits, so that the tone color information generating portion 20 generates the tone color information indicative of the selected tone color. The musical tone control signal generating portion 30 is constructed by a micro computer, memories for storing musical tone control parameter tables and the like, for example. By referring to this table based on the performance information and tone color information, the musical tone control signal generating portion 30 can generate two kinds of musical tone control signals, i.e., first kind of musical tone control signals which are varied in lapse of time and second kind of musical tone control signals which are not varied in lapse of time. These musical tone control signals are determined by a pitch signal PIT, initial-touch performance information, after-touch performance information and tone color information based on the musical tone to be generated by the key-depression. More specifically, the musical tone control signal includes a mouth-inner-pressure signal PRES indicative of the mouth-inner-pressure (i.e., blowing pressure applied to the wind instrument to be performed) and an Embouchure signal EMBS indicative of the opening shape of the performer's lip, holding pressure of the performer's lip which holds the mouth-piece of the wind instrument.

Incidentally, it is possible to connect the so-called mouth controller to the electronic musical instrument, wherein the mouth controller provides the sensor which detects the blowing pressure. In this case, it is possible to partially obtain the performance information from the mouth controller. On the other hand, in the case where the present invention is applied to the electronic wind instrument, the performance information is obtained from the performing portion of the electronic wind instrument. Further, it is possible to adopt the other instruments, automatic performance apparatus and the like as the performance information generating portion 10 and tone color information generating portion 20. In this case, the performance information and tone color information to be generated from the other instruments etc. are supplied to the musical tone control signal generating portion 30. Instead, it is possible to obtain several kinds of musical tone control signals from the other instruments etc., which are then directly supplied to the foregoing musical tone waveform signal generating apparatus consisting of the foregoing three portions 100, 200 and 300.

Figure 2:
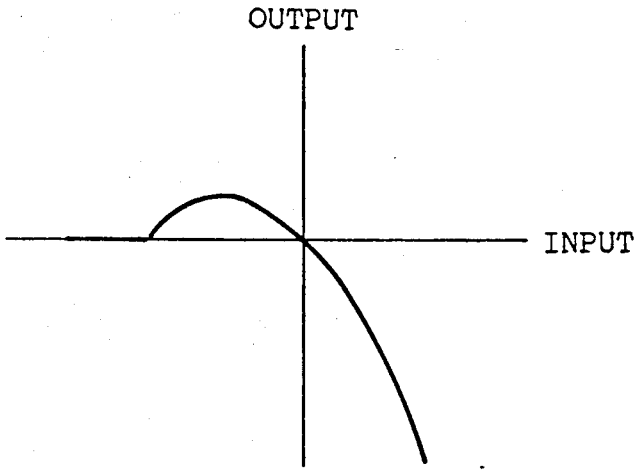
FIG. 2 is a graph showing an example of I/O characteristic of non-linear conversion circuit shown in FIG. 1.
Figure 3:
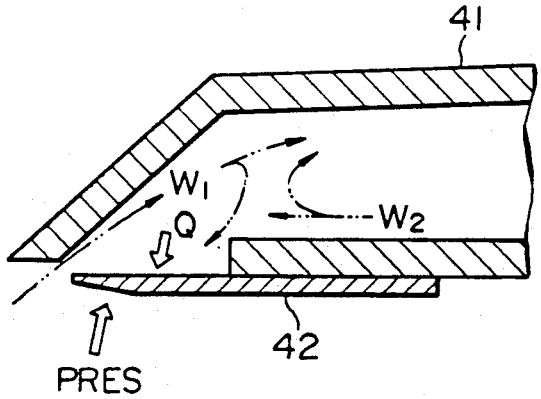
FIG. 3 is a sectional view showing the construction of mouth-piece portion of wind instrument.

Next, the musical tone control signal input portion 100 consists of a subtractor 101 and a non-linear conversion circuit 102. Herein, L1 designates a signal line through which the waveform signal is transmitted in forward direction (hereinafter, simply referred to as forward signal line), and L2 designates another signal line through which the waveform signal is transmitted in backward direction (hereinafter, simply referred to as backward signal line). The subtractor 101 subtracts the mouth-inner-pressure signal PRES from the waveform signal transmitted from the backward signal line L2, and then the subtraction result is supplied to the non-linear conversion circuit 102. The non-linear conversion circuit 102 converts the subtraction result in non-linear manner corresponding to the characteristic as shown in FIG. 2. Thereafter, the output of the non-linear conversion circuit 102 is supplied to the forward signal line L1. Based on the subtraction and non-linear conversion to be carried out in the musical tone control signal input portion 100, it is possible to simulate the operation of shaping an incident wave W1 which is formed by vibration of a reed 42 fixed at an edge portion of a mouthpiece 41 shown in FIG. 3. More specifically, the subtractor 101 simulates the operation of forming the incident wave which is formed in response to the displacement of the reed 42 due to the pressure difference between the mouth-inner-pressure and the pressure of reflected wave which propagates toward the mouthpiece 41 through the resonance tube. In addition, the non-linear conversion circuit 102 simulates the non-linear bending characteristic of the reed 42 to be bent by the pressure applied thereto and non-linear characteristic between the air pressure and air-flow which passes the mouth-piece 41. In response to the Embouchure signal EMBS supplied to the non-linear conversion circuit 102, the basic non-linear conversion characteristic is corrected. Incidentally, it is possible to replace the subtractor 101 by the adder when different signs are respectively given to the mouth-inner-pressure signal PRES and waveform signal from the backward signal line L2.

The waveform signal loop portion 200 consists of adders 201, 202 to be provided on the signal lines L1, L2 respectively. The adder 201 adds the waveform signal from the forward signal line L1 and another waveform signal from the backward signal line L2 together, so that the addition result thereof is outputted to the forward signal line L1. On the other hand, the adder 202 adds the waveform signals from the signal lines L1, L2 together, so that the addition result thereof is outputted to the backward signal line L2. Thus, this waveform signal loop portion 200 can simulate the pressure Q which is cause based on the incident wave W1 and reflected wave W2 from the resonance tube when the air is blown through the gap formed between the mouth-piece 41 and reed 42.

The waveform signal transmission portion 300 is designed to feed back the waveform signal on the signal line L1 to the signal line L2, wherein a low-pass filter (LPF) 301 and a delay circuit 302 is provided at its feedback loop. The LPF 301 is designed to simulate the shape of the resonance tube, while the delay circuit 301 simulates the operation the incident wave which is applied to the mouth-piece 41 and then returned back to the mouth-piece 41 as the reflected wave. The delay time of the delay circuit 302 corresponds to the reciprocating motion of the incident wave which depends on the length of the resonance tube and the distance between the tone hole and terminal portion of resonance tube. In this case, the delay time of the delay circuit 302 can be varied in response to the pitch signal PIT. In other words, the pitch of the musical tone to be generated is determined by the variation of the delay time. Thereafter, the waveform signal on the signal line L1 is outputted.

(2) Basic Operation

Next, description will be given with respect to the basic operation of the present invention.

Based on the performance information and tone color information, the musical tone control signal generating portion 30 generates the mouth-inner-pressure signal PRES, Embouchure signal EMBS and pitch signal PIT. The mouth-inner-pressure signal PRES is subtracted from the waveform signal representative of the reflected wave W2 on the backward signal line L2 in the subtractor 101, so that the subtraction result is supplied to the non-linear conversion circuit 102. This subtraction result is converted into the waveform signal to be transmitted to the forward signal line L1 in accordance with the non-linear characteristic of the reed 42. Thus, this waveform signal transmitted on the forward signal line L1 represents the incident wave W1 corresponding to the displacement of the reed 42 to be bent.

The waveform signal on the signal line L1 is supplied to the waveform signal transmission portion 300 via the waveform signal loop portion 200. This waveform signal is subject to the low-pass filter process by the LPF 301 in accordance with the characteristic of the resonance tube and then delayed by the delay circuit 302. Thereafter, the waveform signal (representative of the reflected wave W2) outputted from the delay circuit 302 is transmitted on the signal line L2 and fed back to the subtractor 101 in the input portion 100 via the waveform signal loop portion 200. Herein, the delay circuit 302 is controlled by the pitch signal PIT, so that the delay circuit 302 delays the waveform signal by the delay time corresponding to the pitch of the performed key. Therefore, the period between first timing when the waveform signal is transmitted to the signal line L1 from the input portion 100 and second timing when the waveform signal is fed back to the input portion 100 via the signal lines L1, L2 will correspond to the pitch of performed key. Thus, the waveform signal on the signal lines L1, L2 has the fundamental frequency corresponding to the pitch of performed key.

During the above-mentioned circulation of the waveform signal on the signal lines L1, L2, the adder 202 functions to partially feed back the waveform signal on L1 to the input portion 100, while the adder 201 functions to partially feed back the waveform signal on L2 to the transmission portion 300. Thus, it is possible to simulate the variation of the air-flow within the mouth-piece 41. In other words, the waveform signal on L1, L2 can simulate the compression wave of air in the wind instrument.

As described heretofore, the present invention can offer the well-designed simulation model which simulates the formation of acoustic signal (i.e., compression wave of air) in the mouth-piece 41 and the transmission of acoustic signal in the resonance tube of the wind instrument. Therefore, it is possible to form the musical tone signal similar to the tone sounded from the wind instrument. In addition to the above-mentioned simulation model of the wind instrument, the present invention can be used to synthesize the musical tone.

In the configuration of FIG. 1, the waveform signal is picked up at the point prior to the LPF 301. However, it is possible to pick up the waveform signal at the arbitrary point on the signal lines L1, L2 because the waveform signal circulates on the signal lines L1, L2.

Figure 4A:
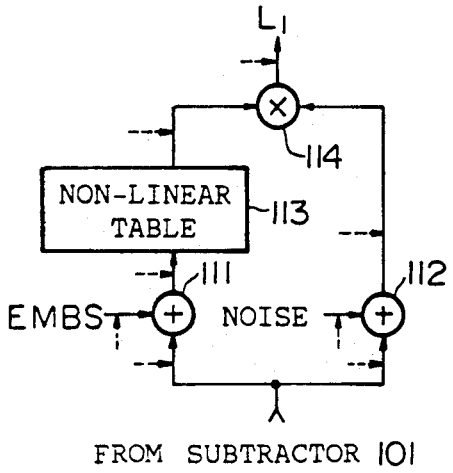
FIGS. 4A to 4F are circuit diagrams showing modified examples of the non-linear conversion circuit shown in FIG. 1.
Figure 4B:
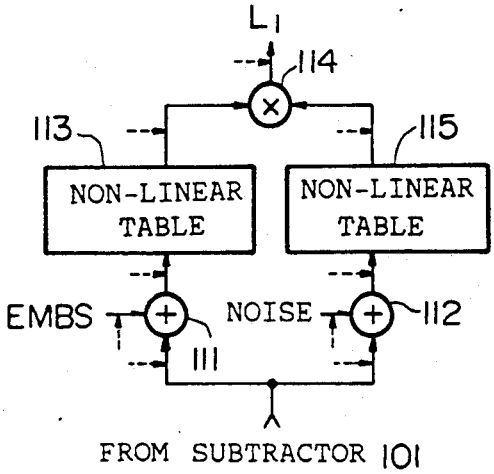

In addition, the non-linear conversion circuit 102 can be constructed by the non-linear tables each having the non-linear I/O characteristic as shown in FIG. 2. In this case, it is possible to change over the non-linear table in response to the Embouchure signal EMBS. Instead, it is possible to construct the non-linear conversion circuit 102 as shown in FIGS. 4A to 4F. In case of FIG. 4A, an adder 111 adds the output of subtractor 101 with the Embouchure signal EMBS, while another adder 112 adds the output of subtractor 101 with the noise signal. Then, the addition result of adder 111 is supplied to a non-linear table 113 wherein the addition result is subject to the non-linear conversion. Thereafter, a multiplier 114 multiplies the conversion result of non-linear table 113 by the addition result of adder 112 to thereby form the waveform signal to be transmitted to the signal line L1. In case of FIG. 4B, a non-linear table 115 is further inserted between the adder 112 and multiplier 114 shown in FIG. 4A. Herein, the addition result of adder 112 is subject to the non-linear conversion, and then the conversion result is supplied to the multiplier 114. In this case, the above-mentioned noise signal is generated from the musical tone control signal generating portion 30, and the characteristic of non-linear table can be arbitrarily determined. Instead of the noise signal, it is possible to use other signal which is formed based on the performance information. Incidentally, it is further provide the operation circuits which perform the operation (such as addition, subtraction, multiplication and division) on the musical tone control signal, filters, other non-linear circuits, delay circuits and the like at the points as indicated by dotted arrows in FIGS. 4A, 4B. By modifying the non-linear conversion circuit 102 as shown in FIGS. 4A, 4B, it is possible to form several kinds of musical tone signals.

Figure 4C:
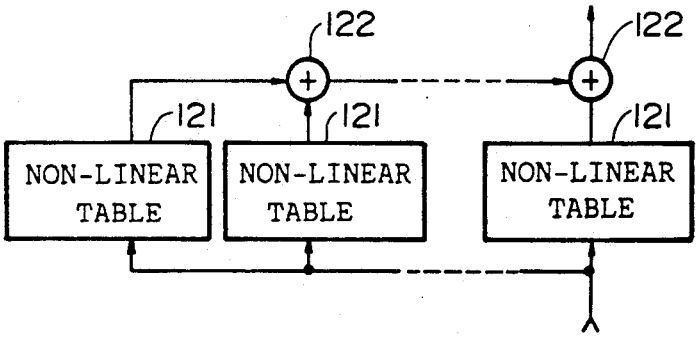
Figure 4D:
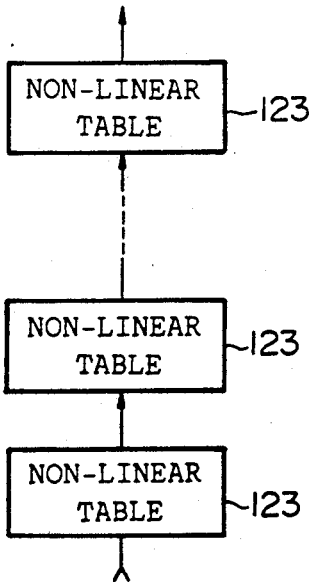

In case of FIG. 4C, plural non-linear tables 121 are connected in parallel and the outputs thereof are sequentially added in the adders 122. In case of FIG. 4D, plural non-linear tables 123 are connected in series. In case of FIG. 4E, plural non-linear tables 124 and multipliers 125 are alternatively connected in series, wherein coefficients $a_0, a_1, \ldots a_n$ are provided for multipliers 125 respectively. In this case, such coefficients $a_0, a_1, \ldots$ can be fixed at the predetermined values in advance, or they can be varied by the musical tone control signal generating portion 30 in lapse of time or in response to the performance information. By modifying the non-linear conversion circuit 102 as shown in FIGS. 4C, 4D, 4E, it is possible to perform the non-linear conversion having large freedom of degree.

Figure 4E:
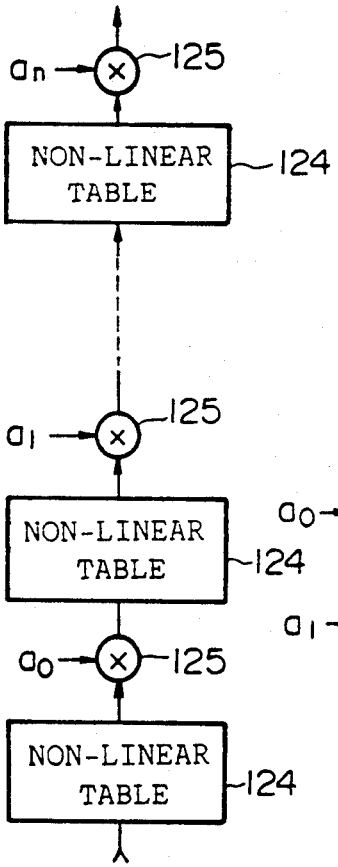
Figure 4F:
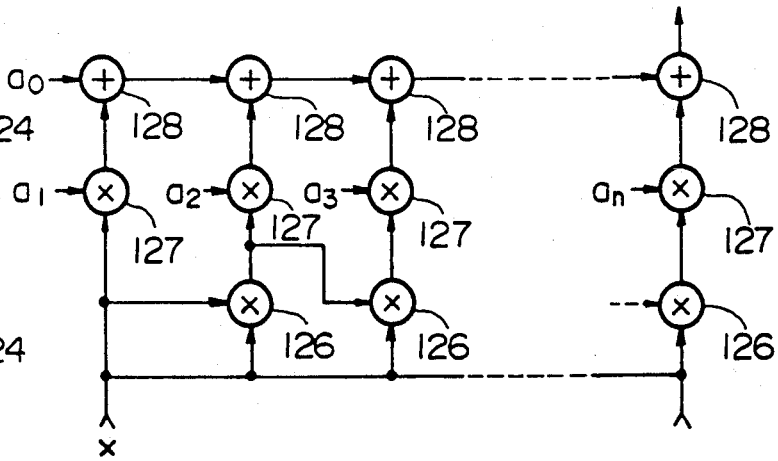

Further, instead of the non-linear tables 113, 115 etc., it is possible to design the non-linear conversion table 102 as shown in FIG. 4F wherein the non-linear conversion is carried out by the mathematical sum of series. More specifically, the circuit shown in FIG. 4F provides multipliers 126 each raising the input x to next degree of series, multipliers 127 which multiply the multiplication results of multipliers 126 by coefficients $a_1, a_2, \ldots$ respectively and adders 128 which sequentially add the multiplication results of multipliers 127 together. Thus, the output of this circuit can be represented by the following formula corresponding to the mathematical sum of series:

$$a_0 + a_1x + a_2x^2 + \ldots + a_nx^n$$

where the coefficients $a_0, a_1, a_2, \ldots$ are set as similar to the case of FIG. 4E. As shown in FIG. 4F, it is possible to omit the non-linear table by performing the non-linear conversion on the input signal x based on the mathematical sum of series.

Figure 5A:
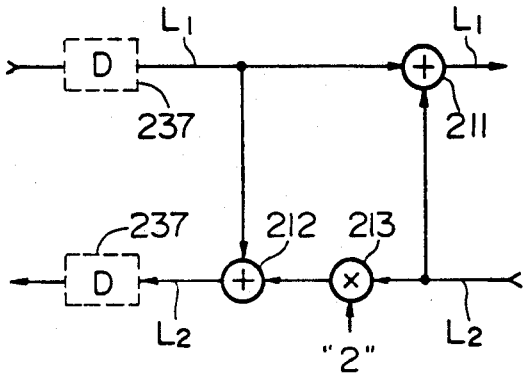
FIGS. 5A to 5D are circuit diagrams showing modified examples of the waveform signal loop portion shown in FIG. 1.

Next, the waveform signal loop portion 200 can be modified as shown in FIGS. 5A to 5D. In case of FIG. 5A, an adder 211 adds the waveform signals on the signal lines L1, L2 together to thereby transmit its addition result onto the signal line L1. In addition, a multiplier 213 doubles the waveform signal on the signal line L2. Further, an adder 212 adds the multiplication result of multiplier 213 with the waveform signal on the signal line L1 to thereby transmit its addition result onto the signal line L2 toward to the input portion 100. This circuit shown in FIG. 5A is the equivalent circuit of the waveform signal loop portion 200 shown in FIG. 1.

Figure 5B:
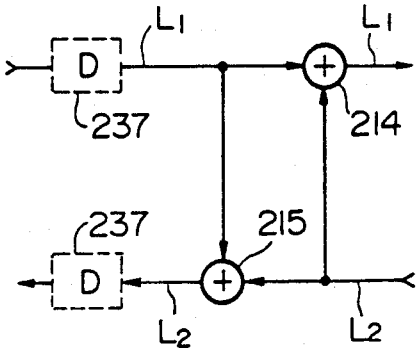

In case of FIG. 5B, an adder 214 adds the waveform signals on the signal lines L1, L2 together to thereby transmit its addition result onto the signal line L1 toward to the transmission portion 300, while another adder 215 adds the waveform signals on the signal lines L1, L2 together to thereby transmit its addition result onto the signal line L2 toward the input portion 100.

Figure 5C:
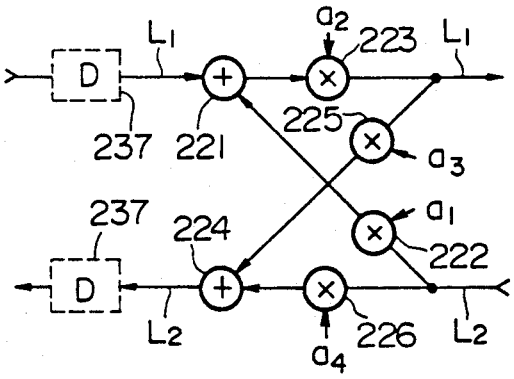

In case of FIG. 5C, a multiplier 222 multiplies the waveform signal on the signal line L2 by the coefficient $a_1$ to thereby output its multiplication result to an adder 221 wherein the multiplication result is added to the waveform signal on the signal line L1. Then, the addition result of adder 221 is multiplied by the coefficient $a_2$ in a multiplier 223, so that the multiplication result is transmitted onto the signal line L1 toward the transmission portion 300. On the other hand, a multiplier 225 multiplies the multiplication result of multiplier 223 by the coefficient $a_3$, while another multiplier multiplies the waveform signal on the signal line L2 by the coefficient $a_4$. Thereafter, an adder 224 adds these multiplication results of multipliers 225, 226 together to thereby transmit its addition result onto the signal line L2 toward the input portion 100. Herein, the coefficients $a_1$ to $a_4$ can be fixed at the predetermined values, or they can be varied by the musical tone control signal generating portion 30 in lapse of time or in response to the performance information.

Figure 5D:
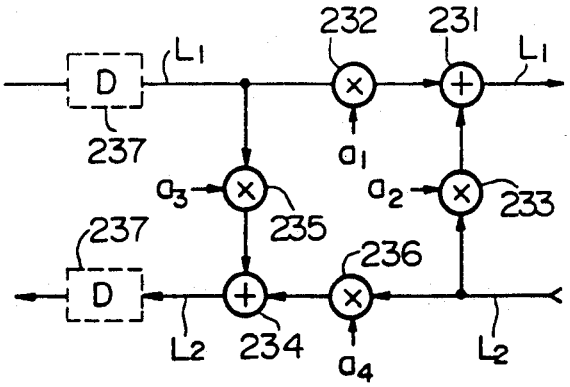

In case of FIG. 5D, a multiplier 232 multiplies the waveform signal on the signal line L1 by the coefficient $a_1$, while another multiplier 233 multiplies the waveform signal on the signal line L2 by the coefficient $a_2$. Then, an adder 231 adds these multiplication results of multipliers 232, 233 together to thereby transmit its addition result onto the signal line L1 toward the transmission portion 300. On the other hand, a multiplier 235 multiplies the waveform signal on the signal line L1 by the coefficient $a_3$, while another multiplier 236 multiplies the waveform signal on the signal line L2 by the coefficient $a_4$. Then, an adder 234 adds these multiplication results of multipliers 235, 236 together to thereby transmit its addition result onto the signal line L2 toward the input portion 100.

As described above, by modifying the configuration of waveform signal loop portion 200 as shown in FIGS. 5A to 5D, it is possible to simulate the variation of air-flow in the mouth-piece 41 of several kinds of wind instruments. In addition, the freedom of degree can be raised so that several kinds of musical tone signals can be formed with ease.

Incidentally, as shown by dotted blocks in FIGS. 5A to 5D, it is possible to further provide delay circuits 237 at input sides of the waveform signal loop portion 200. These delay circuits 237 are designed to delay the waveform signals by the predetermined short delay time which depends on the construction of the mouth-piece 41.

[B] FIRST EMBODIMENT

Next, description will be given with respect to the first embodiment of the present invention. Herein, the musical tone waveform signal generating apparatus according to the first embodiment as shown in FIG. 6 is suitable to form the musical tone signal corresponding to the wind instruments such as the clarinet, saxophone etc.

Figure 6:
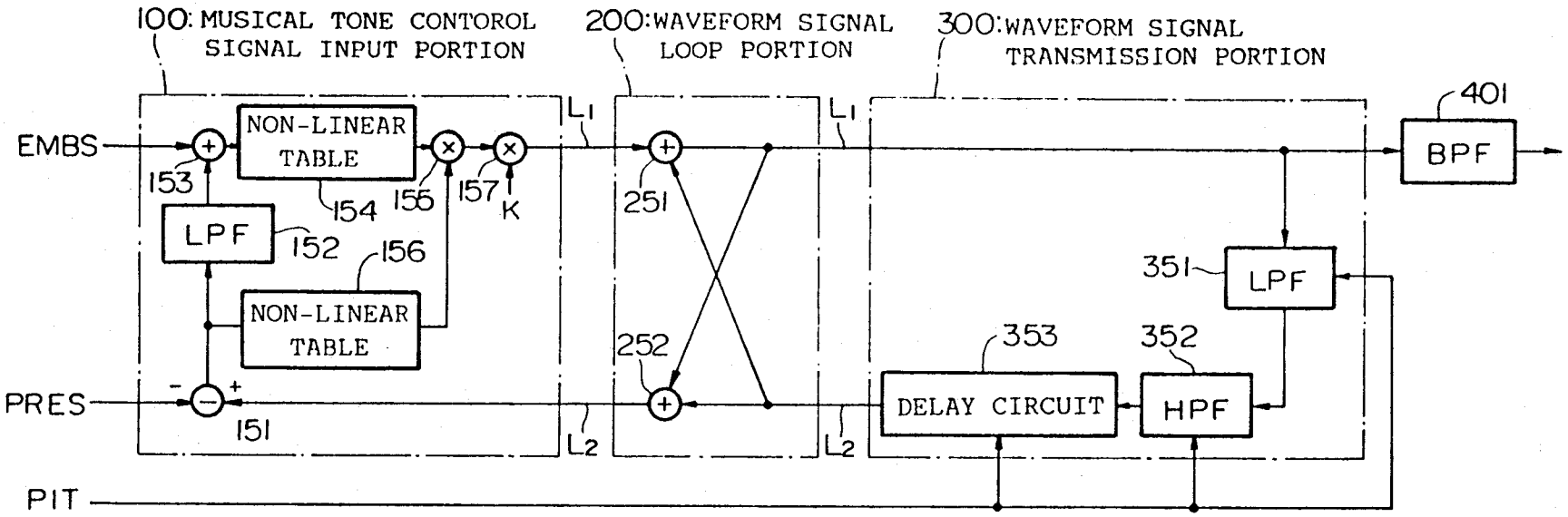
FIG. 6 is a block diagram showing the musical tone waveform signal generating apparatus according to a first embodiment of the present invention.

This musical tone waveform signal generating apparatus shown in FIG. 6 is mainly constructed by the musical tone control signal input portion 100, waveform signal loop portion 200 and waveform signal transmission portion 300. Herein, the present musical tone waveform signal generating apparatus receives the pitch signal PIT corresponding to the frequency of the musical tone to be generated, Embouchure signal EMBS and mouth-inner-pressure signal PRES both of which are varied based on the performance information.

Figure 7:
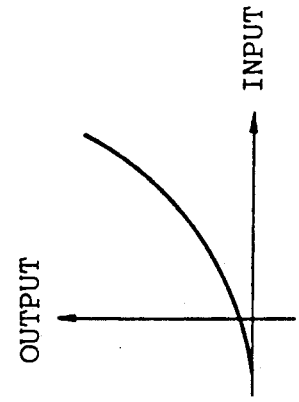

The musical tone control signal input portion 100 includes a subtractor 151, a low-pass filter (LPF) 152, an adder 153, non-linear tables 154, 156 and multipliers 155, 157. The subtractor 151 subtracts the mouth-inner-pressure signal PRES from the waveform signal on the signal line L2 to thereby output a pressure difference signal indicative of the pressure difference by which the reed 42 of the mouth-piece 41 is varied in shape (see FIG. 3). The LPF 152 removes higher-frequency component from the pressure difference signal outputted from the subtractor 151. Such LPF 152 is provided because the reed 42 does not respond to the higher-frequency component of the air-flow. The adder 153 adds the Embouchure signal EMBS to the output of LPF 152 to thereby output the addition result thereof to the non-linear table 154. The non-linear table 154 is provided for simulating the displacement of the reed 42 under the air pressure, so that the non-linear table 154 has the I/O characteristic as shown in FIG. 7. Due to the non-linear conversion, the output of non-linear table 154 will represent the air-passing area of the reed 42 of the mouth-piece 41. The output of non-linear table 154 is supplied to the multiplier 155.

Figure 8:
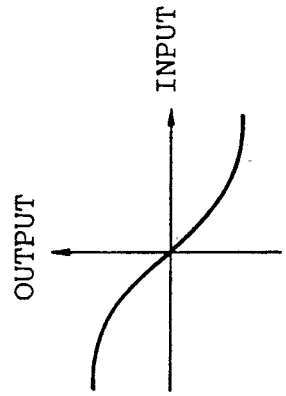
FIGS. 7 and 8 are graphs showing I/O characteristics of non-linear tables shown in FIG. 6.

Meanwhile, the multiplier 155 also receives the output of non-linear table 156 to which the pressure difference signal is supplied from the subtractor 151. In general, even if the pressure difference applied to the reed 42 becomes larger in the relatively narrow tube, the air-flow velocity must be saturated so that the pressure difference will not be proportional to the air-flow velocity any more. Thus, the non-linear table 156 simulates such saturation phenomenon. This non-linear table 156 has the I/O characteristic as shown in FIG. 8. In short, the pressure difference signal is corrected under consideration of the pressure difference applied to the reed 42 affects the air-flow velocity, and then the corrected pressure difference signal outputted from the non-linear table 156 is supplied to the multiplier 155. Then, the multiplier 155 multiplies the output of non-linear table 154 representative of the air-passing area of the reed 42 by the output of non-linear table 156 corresponding to the corrected pressure difference signal. Thus, the multiplication result of multiplier 155 will represent the air-flow velocity at the reed 42 in the mouth-piece 41. Then, the multiplier 157 multiplies the multiplication result of multiplier 155 by a fixed coefficient k representative of the impedance (i.e., air resistance) in the mouth-piece 41, so that the multiplication result thereof is transmitted onto the signal line L1 toward the waveform signal loop portion 200 as tone pressure signal.

The waveform signal loop portion 200 contains adders 251, 252 as similar to the foregoing waveform signal loop portion 200 shown in FIG. 1. As described before, this waveform signal loop portion 200 simulates the variation of air-flow in the mouth-piece 41.

Next, the waveform signal transmission portion 300 provides a LPF 351, a high-pass filter (HPF) 352 and a delay circuit 353 to be connected between the signal lines L1, L2. The cut-off frequencies of the LPF 351, HPF 352 are controlled in response to the pitch of the musical tone to be generated, i.e., the pitch signal PIT. In this case, it is possible to omit the HPF 352 from the waveform signal transmission portion 300. The delay circuit 353 is designed as similar to the foregoing delay circuit 302 shown in FIG. 1. Further, a band-pass filter (BPF) 401 is connected at the output side of the signal line L1 in order to simulate the radiation characteristic of the musical tone of which air vibration is radiated in the air. Thereafter, the waveform signal is outputted from the BPF 401.

The first embodiment as shown in FIG. 6 operates as similar to the foregoing circuit shown in FIG. 1. Thus, the first embodiment is well designed to simulate the formation and transmission of the acoustic signal to be propagated in the wind instrument such as the clarinet, saxophone etc., so that it is possible to obtain the artificial musical tone which is similar to the sound of wind instrument.

[C] SECOND EMBODIMENT

Next, description will be given with respect to the musical tone waveform signal generating apparatus according to the second embodiment which is suitable for generating the musical tone signal of the brass instrument.

Figure 9:
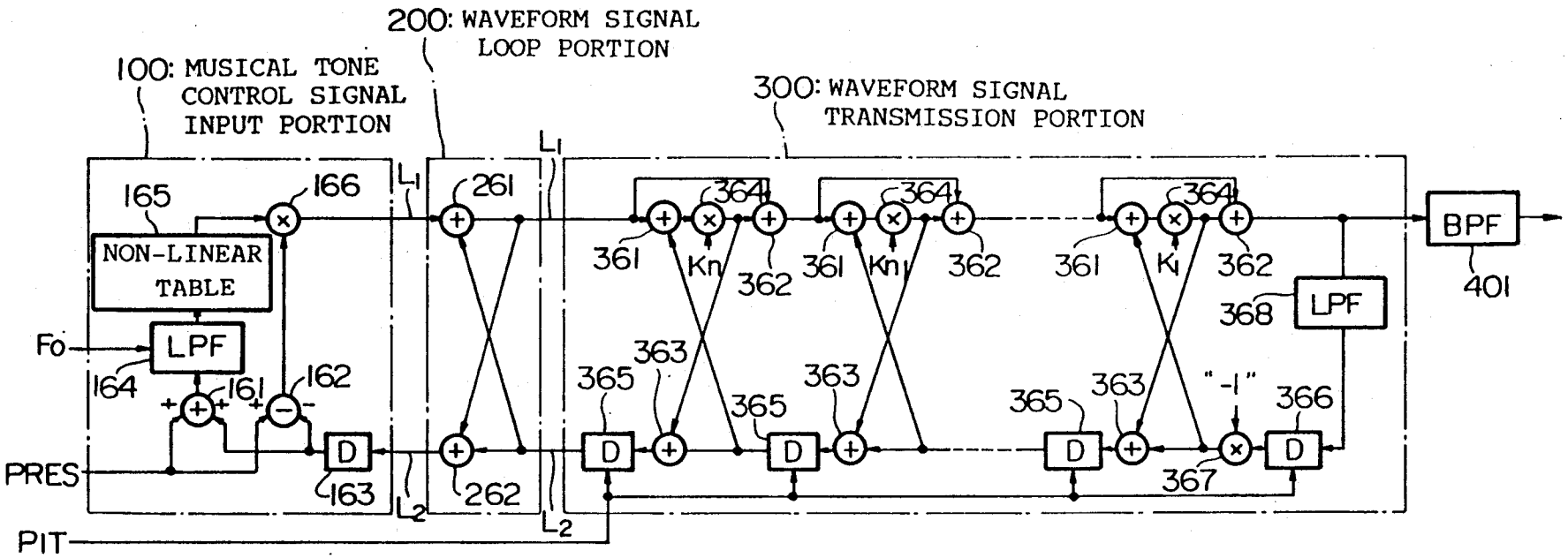
FIG. 9 is a block diagram showing a second embodiment of the present invention.

The musical tone waveform signal generating apparatus according to the second embodiment as shown in FIG. 9 is mainly constructed by the musical tone control signal input portion 100, waveform signal loop portion 200 and waveform signal transmission portion 300 as similar to the foregoing first embodiment and the like. The musical tone control signal generating portion 30 (not shown in FIG. 9) outputs the pitch signal PIT and mouth-inner-pressure signal PRES to the musical tone control signal input portion 100. Instead of the Embouchure signal EMBS, the musical tone control signal generating portion 30 outputs a cut-off signal $F_0$ representative of the frequency of the musical tone to be generated. Herein, the cut-off signal $F_0$ does not necessarily correspond to the pitch signal PIT.

Figure 10:
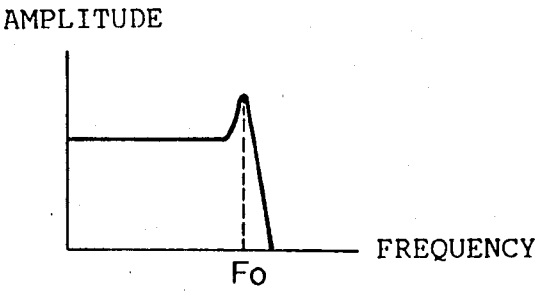
FIG. 10 is a graph showing a frequency-amplitude characteristic of low-pass filter shown in FIG. 9.
Figure 11:
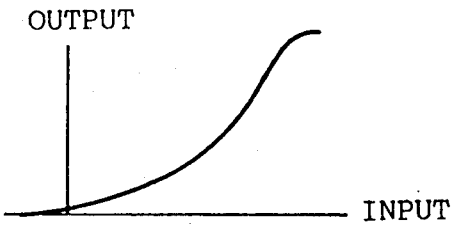
FIG. 11 is a graph showing I/O characteristic of non-linear table shown in FIG. 9.

The musical tone control signal input portion 100 contains an adder 161, a subtractor 162, a delay circuit 163, a LPF 164, a non-linear table 165 and a multiplier 166. The adder 161 adds the mouth-inner-pressure signal PRES to the waveform signal on the signal line L2 which is delayed by small delay time in the delay circuit 163, so that the addition result thereof represents the pressure of pressing the performer's lip to the mouth piece 41. Then, the LPF 164 removes the higher-frequency component from the addition result of adder 161. Herein, the cut-off frequency and resonance frequency of the LPF 164 are controlled by the cut-off signal $F_0$ as shown in FIG. 10. Such frequency control is carried out on the LPF 164 in order to simulate the holding manner of the performer's lip which holds the mouth-piece of the brass instrument. Because, such holding manner of the performer's lip affects the frequency of the musical tone to be sounded from the brass instrument. In addition, this LPF 164 and the delay times to be applied to the waveform signal in the waveform signal transmission portion 300 function to control the oscillation frequency in the signal circulating loop consisting of the signal lines L1, L2 and thereby control the frequency of the musical tone to be generated. The non-linear table 165 connected to the LPF 164 is designed to simulate the opening manner of the performer's lip against the pressure at the mouth-piece, wherein this table 165 has the I/O characteristic as shown in FIG. 11. Thus, the output of non-linear table 165 will represent the opening area of the performer's lip. Such output of non-linear table 165 is supplied to the multiplier 166.

The multiplier 166 also receives the output of subtractor 162 in which the delayed waveform signal from the delay circuit 163 is subtracted from the mouth-inner-pressure signal PRES. Thus, the subtractor 162 outputs the pressure difference signal representative of the pressure difference between the pressures at the inside and outside of the performer's lip. Then, the multiplier 166 multiplies the pressure difference signal from the subtractor 162 by the output of non-linear table 165 to thereby transmit its multiplication result onto the signal line L1 toward the waveform signal loop portion 200. Herein, the multiplication result of multiplier 166 represents the air-flow velocity at the mouth-piece. Thus, the waveform signal to be supplied to the waveform signal loop portion 200 can simulate the sound wave to be generated at the mouth-piece of the brass instrument.

As similar to the foregoing waveform signal loop portion 200 shown in FIG. 1, the present waveform signal loop portion 200 consists of adders 261, 262. Therefore, as described before, the present waveform signal loop portion 200 can simulate the variation of the air-flow in the mouth-piece.

The waveform signal transmission portion 300 is designed based on the so-called Kelly-Lochbaum cascade circuit configuration. More specifically, the present waveform signal transmission portion 300 contains a delay circuit 366 for delaying the waveform signal, a multiplier 367 for multiplying the waveform signal by fixed coefficient "−1", a LPF 368 and n-stages of ladder circuits each consisting of adders 361 to 363 for adding the waveform signals, a multiplier 364 for multiplying the waveform signal by fixed coefficient K ($=K_n, K_{n-1}, \ldots, K_1$) and a delay circuit 365 for delaying the waveform signal. Such cascade circuit is normally used for the speech synthesis because it is well designed to simulate the propagation of the sound wave in the cylindrical tube. Herein, the delay circuits 365, 366 are controlled by the pitch signal PIT, so that the sum of delay times of all delay circuits correspond to the frequency of the musical tone to be generated. The waveform signal is picked up from the input side of the LPF 368 via the BPF 401 as similar to the first embodiment shown in FIG. 6.

The above-mentioned second embodiment operates as similar to the foregoing first embodiment and the like. Thus, the second embodiment can simulate the formation and transmission of the acoustic wave signal in the brass instrument, so that it is possible to obtain the musical tone similar to the sound generated from the brass instrument.

Figure 13:
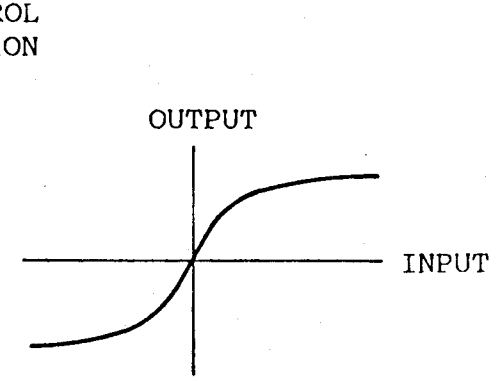
FIG. 13 is a graph showing I/O characteristic of non-linear table shown in FIG. 12.
Figure 12:
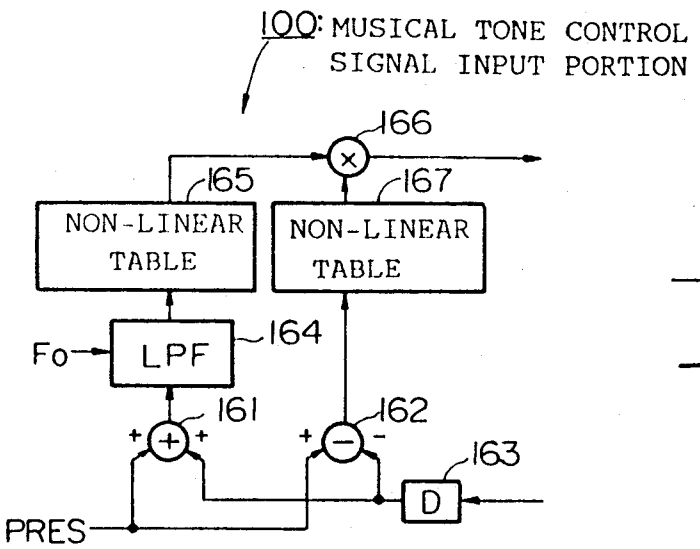
FIG. 12 is a block diagram showing a modified example of musical tone control signal input portion shown in FIG. 9.

Meanwhile, the musical tone control signal input portion 100 can be modified as shown in FIG. 12. In FIG. 12, a non-linear table 167 is further inserted between the subtractor 162 and multiplier 166. This non-linear table 167 is designed to simulate the saturation of the air-flow velocity as similar to the foregoing non-linear table 156 (see FIGS. 6, 8). This non-linear table 167 has the I/O characteristic as shown in FIG. 13, by which the multiplication result of multiplier 166 can simulate the air-flow with accuracy. Thus, the non-linear table 167 can improve the simulation of the air-flow in the mouth-piece of the brass instrument, so that it is possible to obtain the musical tone signal which is further closer to the sound of brass instrument.

[D] THIRD EMBODIMENT

Next, description will be given with respect to the musical tone waveform signal generating apparatus according to the third embodiment which is not designed to simulate the non-electronic musical instrument but to synthesize the brand-new musical tone signal.

Figure 14:
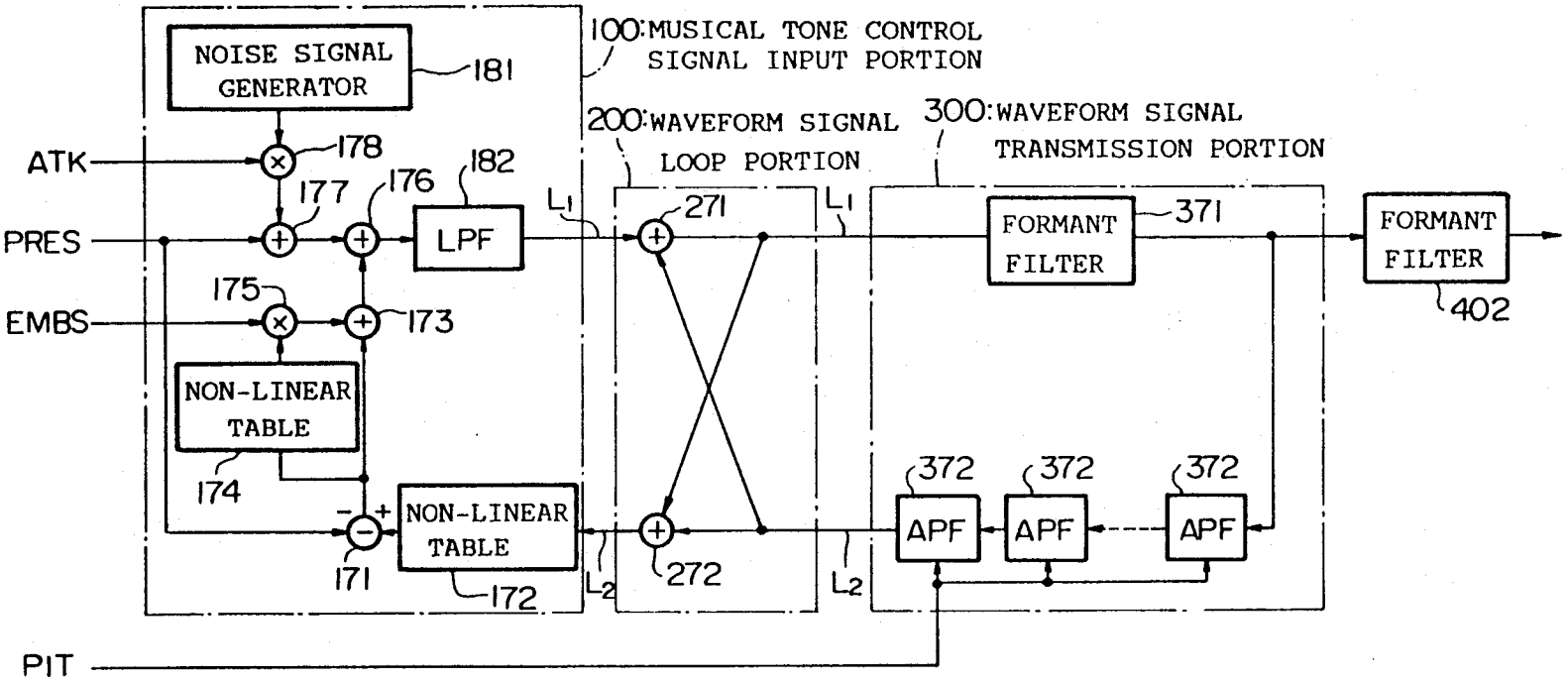
FIG. 14 is a block diagram showing a third embodiment of the present invention.

FIG. 14 shows the third embodiment which is mainly constructed by the musical tone control signal input portion 100, waveform signal loop portion 200 and waveform signal transmission portion 300 as similar to the foregoing first embodiment etc. In addition to the foregoing pitch signal PIT, mouth-inner-pressure signal PRES and Embouchure signal EMBS, the musical tone control signal generating portion 30 (not shown in FIG. 14) outputs an attack signal ATK which is generated just after the leading edge timing of the musical tone signal.

Figure 15:
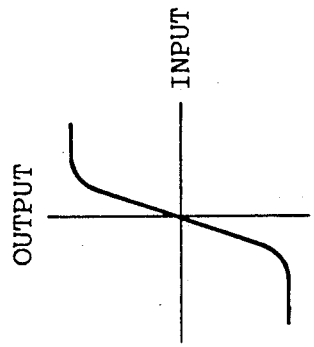
FIGS. 15 and 16 are graphs showing I/O characteristics of non-linear tables shown in FIG. 14.

The musical tone control signal input portion 100 contains a subtractor 171, non-linear tables 172, 174, adders 173, 176, 177, multipliers 175, 178, a noise signal generator 181 and a LPF 182. Herein, the waveform signal on the signal line L2 is supplied to the non-linear table 172. The subtractor 171 subtracts the mouth-inner-pressure PRES from the output of non-linear table 172, wherein this subtractor 171 corresponds to the foregoing subtractor 101 shown in FIG. 1. The non-linear table 172 has the I/O characteristic as shown in FIG. 15. Therefore, this non-linear table 172 functions as the limiter which limits the amplitude of the waveform signal on the signal line L2 within the predetermined amplitude range. Thus, the loop gain of the loop consisting of the signal lines L1, L2 is suppressed so that the oscillation can be stabilized so as to obtain the musical tone signal.

Figure 16:
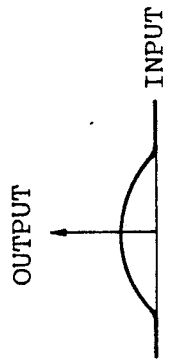

The subtraction result of subtractor 171 is supplied to the multiplier 175 via the non-linear table 174, wherein the subtraction result is multiplied by the Embouchure signal EMBS. Then, the multiplication result of multiplier 177 is supplied to the adder 173 to which the subtraction result of subtractor 171 is also supplied. In this case, the non-linear table 174 has the I/O characteristic as shown in FIG. 16, by which the small amplitude is amplified but large amplitude is reduced to zero level. Thus, when the amplitude of the subtraction result of subtractor 171 is relatively large, the subtraction result is directly outputted from the adder 173 as it is. In this case, the waveform signal which circulates the signal lines L1, L2 is subject to the stable oscillation. On the other hand, when the amplitude of the subtraction result is relatively small, the subtraction result is subject to the non-linear conversion in such a manner that the subtraction result is amplified in the non-linear table 174. Thus, the multiplication result of multiplier 175 is mainly outputted from the adder 173. In this case, the oscillation of the waveform signal which circulates the signal lines L1, L2 depends on the non-linear conversion performed by the non-linear table 174. In other words, this oscillation is controlled by the Embouchure signal EMBS.

Meanwhile, the multiplier 178 multiplies the noise signal from the noise signal generator 181 by the attack signal ATK to thereby output the multiplication result thereof to the adder 177. The adder 177 adds the multiplication result of multiplier 178 to the mouth-inner-pressure signal PRES. Then, the addition result of adder 177 is supplied to the adder 176 to which the addition result of adder 173 is also supplied. Under the above-mentioned operations, the mouth-inner-pressure PRES is added to the waveform signal on the signal lines L1, L2. In addition, the noise signal whose amplitude varies irregularly at its leading edge portion is added to the waveform signal. The LPF 182 removes the higher-frequency component from the addition result of adder 176, and then the output of LPF 182 is transmitted onto the signal line L1 toward the waveform signal loop portion 200.

As similar to the foregoing embodiments, the waveform signal loop portion 200 according to the third embodiment is also constructed by adders 271, 272. Thus, as described before, the waveform signal loop portion 200 simulates the transmission and reflection of the waveform signal.

Next, the waveform signal transmission portion 300 is constructed by a formant filter 371 and all-pass filters (APF) 372 to be connected between the signal lines L1, L2. The formant filter 371 is designed to apply the desirable frequency characteristic (corresponding to the acoustic transmission characteristic of the resonance tube) to the waveform signal to be transmitted on the signal line L1. The phase characteristic of APF 372 is varied by the pitch of the musical tone to be generated, i.e., pitch signal PIT. The sum of phase delays applied to the waveform signal by the APF 372 (corresponding to the signal delay of the foregoing delay circuit 302 shown in FIG. 1) corresponds to the frequency of the musical tone to be generated. In FIG. 14, another formant filter 402 is connected to the output side of formant filter 371. Thus, the waveform signal circulating onto the signal lines L1, L2 can be picked up via the formant filter 402.

The above-mentioned third embodiment fundamentally operates as similar to the foregoing circuit shown in FIG. 1. However, the third embodiment is characterized by that several kinds of controls can be carried out on the waveform signal to be transmitted on the signal lines L1, L2 by use of several kinds of control signals PRES, EMBS, ATK in the musical tone control signal input portion 100. In short, the third embodiment can perform the complicated control when forming the waveform signal.

[E] MODIFICATIONS

The embodiments described herein can be modified as follows:

(1) It is possible to configure the filter in the waveform signal transmission portion 300 by use of the known Infinite-Impulse-Response (IIR) filter or Finite-Impulse-Response (FIR) filter.

(2) If the analog circuit is adopted as the musical tone waveform signal generating apparatus, the filter can be configured by use of the CR passive filter or active filter. In this case, the analog circuit element such as the transistor, diode etc. can be used as the non-linear conversion circuit. In addition, the operation circuits such as the adder and multiplier can be configured by use of the analog operation circuit using the operational amplifier and the like. Further, the analog delay circuit such as BBD, LCR can be used as the delay circuit.

(3) In the foregoing embodiments, the musical tone control signal generating portion 30 outputs the Embouchure signal EMBS, mouth-inner-pressure signal PRES, pitch signal PIT, cut-off signal $F_0$ and attack signal ATK which are used to control the operation of forming the musical tone signal. Other than these signals, it is possible to use other signals to be formed based on the performance information, tone color information and the like. For example, it is possible to use the envelope signal which rises up at key-on timing, varies in lapse of time and then attenuates at key-off timing. In addition, it is possible to utilize the low-frequency signal which is used for the modulation such as tremolo, vibrato etc.

As described heretofore, this invention may be practiced or embodied in still other ways without departing from the spirit or essential character thereof. Therefore, the preferred embodiments described herein are illustrative and not restrictive, the scope of the invention being indicated by the appended claims and all variations which come within the meaning of the claims are intended to be embraced therein.

What is claimed is:

1. A musical tone waveform signal generating apparatus comprising:

(a) a first signal line through which a waveform signal is transmitted in forward direction;

(b) a second signal line through which said waveform signal outputted from said first signal line is transmitted in a backward direction;

(c) non-linear conversion means which receives said waveform signal from said second signal line and a musical tone control signal which is used to control characteristics of a musical tone to be generated, said conversion means converting said waveform signal in response to said musical tone control signal in accordance with a non-linear conversion characteristic so that a converted waveform signal obtained from said conversion means is outputted to said first signal line;

(d) transmission means for transmitting said waveform signal from said first signal line to said second signal line and delaying said waveform signal by a delay time corresponding to a pitch of the musical tone to be generated, so that a delayed waveform signal to be outputted from said transmission means is fed back to said second signal line; and (e) signal loop means coupled to the first and second signal lines at a location between said conversion means and said transmission means, said signal loop means mixing said waveform signals on said first and second signal lines by transmitting said waveform signal on one of said first and second signal lines to the other of said first and second signal lines.

2. A musical tone waveform signal generating apparatus according to claim 1 wherein said signal loop means includes first operation means provided on said first signal line and second operation means provided on said second signal line, said first operation means mixing said waveform signals on said first and second signal lines together so that a mixed waveform signal outputted from said first operation means is outputted to said first signal line, said second operation means mixing said waveform signals on said first and second signal lines together so that a mixed waveform signal outputted from said second operation means is outputted to said second signal line.

3. A musical tone waveform signal generating apparatus according to claim 1 wherein said signal loop means comprises:

(a) first adder means provided on said first signal line for adding said waveform signals on said first and second signal lines together so that an added waveform signal is outputted to said first signal line;

(b) second adder means provided on said second signal line for adding said waveform signals on said first and second signal lines together so that an added waveform signal is outputted to said second signal line;

(c) first multiplier means inserted between said second signal line and said first adder means for multiplying said waveform signal on said second signal line by a first coefficient; and (d) second multiplier means inserted between said first signal line and said second adder means for multiplying said waveform signal on said first signal line by a second coefficient.

4. A musical tone waveform signal generating apparatus according to claim 1 wherein said conversion means effects a predetermined non-linear conversion on said waveform signal from said second signal line in response to said musical tone control signal.

* * * * *